US005644296A

United States Patent [19]

Miller

[11] Patent Number: 5,644,296

[45] Date of Patent: Jul. 1, 1997

[54] A-1-2-3, BODY GUARD ALARM

[76] Inventor: Marvin Leon Miller, 3309 Barton Ave., Richmond, Va. 23222

[21] Appl. No.: 186,375

[22] Filed: Jan. 25, 1994

[51] Int. Cl.[6] ..... G08B 23/00

[52] U.S. Cl. ..... 340/573; 340/574; 340/692; 340/693; 396/429; 396/544

[58] Field of Search ..... 340/573, 692, 340/693, 574; 354/295

[56] References Cited

U.S. PATENT DOCUMENTS

| | | | |
|---|---|---|---|
| 4,843,336 | 6/1989 | Kuo | 340/573 |
| 5,195,448 | 3/1993 | Sims | 109/6 |
| 5,223,815 | 6/1993 | Rosenthal et al. | 340/539 |
| 5,266,927 | 11/1993 | Sanders | 340/573 |
| 5,289,164 | 2/1994 | Novak | 340/574 |
| 5,552,850 | 9/1996 | Matsumoto | 356/295 |

*Primary Examiner*—Jeffery Hofsass
*Assistant Examiner*—Benjamin C. Lee

[57] ABSTRACT

A self-contained A-1-2-3 Body Guard Alarm which is a 3 in 1 system that simultaneously activates 3 units by actuation of a single button to identify an attacker in two ways and gets the attention of other people in a third way. The unit is worn on the back side of the hand using straps by sliding the hand and fingers through a cuff into an open-finger glove of the alarm unit, and locks the unit into place on the hand by a cuff lock in order to prevent the attacher from removing it from the wearer. The unit can be used at night because it uses a flash.

3 Claims, 4 Drawing Sheets

A-1-2-3, BODY GUARD ALARM

A mini size unit identify's the attacker in three ways simultaneously.

BACKGROUND OF THE INVENTION

The A-1-2-3, Body Guard Alarm is for a person that walks alone at night or day, or going one place to another. For kids that's away from their parent eye sight that would protect this person from an attacker.

SUMMARY OF THE INVENTION

The A-1-2-3, Body Guard Alarm is a multi-purpose unit that's a self defense device that simultaneously helps to deter and identify an attacker in three ways.

The primary advantage of the A-1-2-3, Body Guard Alarm, is that this new invention doesn't look like what it does to catch an attacker .

One primary object of this present invention is the mini cassette player that's used to deter the attacker, by calling out for help.

Another object of this present invention is the spray valves, that sprays a color dye on the attacker.

Still another object of this present invention is the mini camera that takes pictures of the attacker.

Still another object of this present invention, the A-1-2-3, Body Guard Alarm is that once it's secured to the arm it locks to prevent the attacker from removing it.

DETAIL DESCRIPTION OF THE PREFERRED EMBODIMENT(S)

Figures 1, 1A:
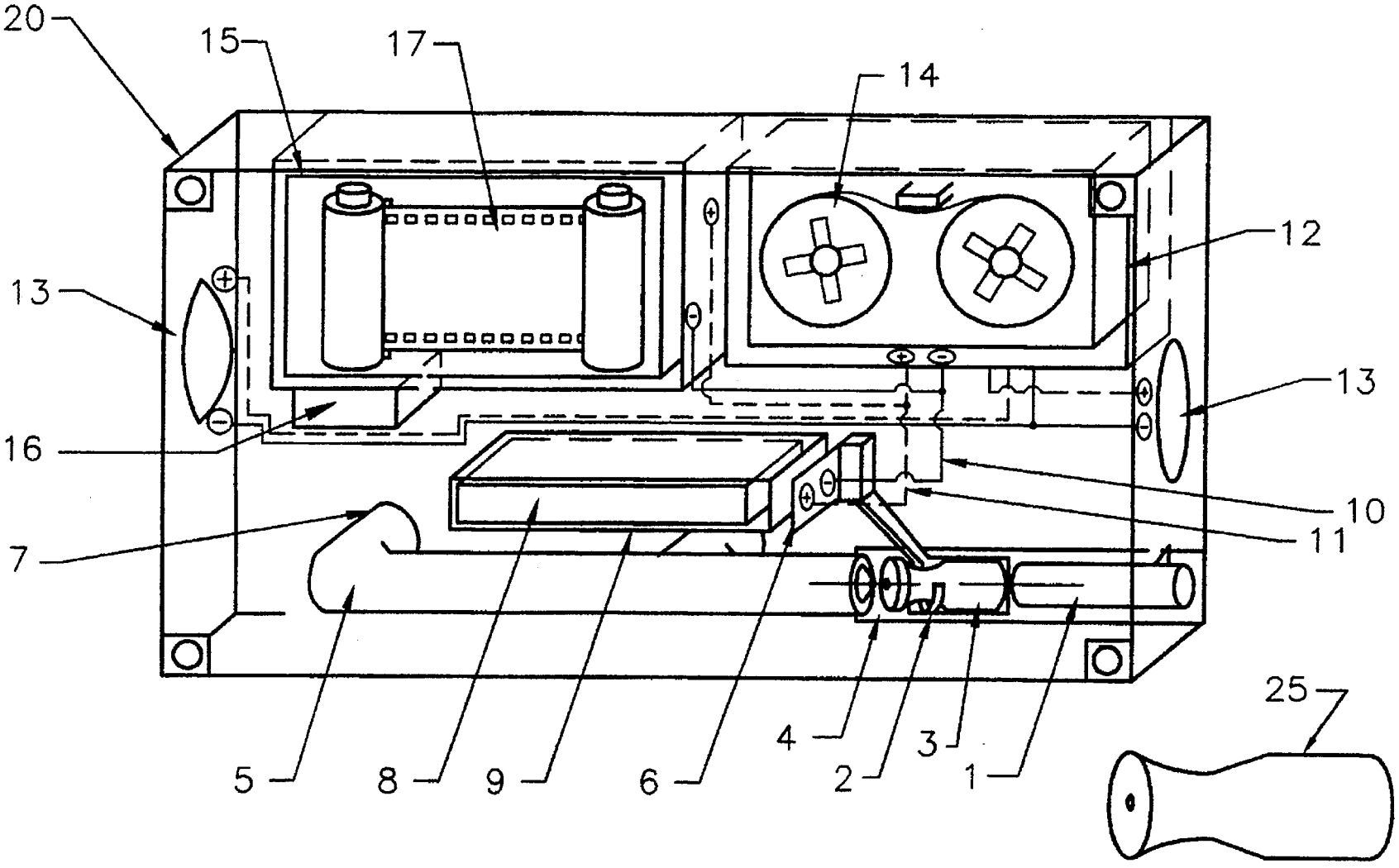
FIGS. 1 and FIG. 1*a* show the embodiment of this unit and how it's encased from the back point of view, which is FIG. 2 from the front with the cleaning cylinder to prevent the dye from drying up .

The A-1-2-3, Body Guard Alarm is a multi-purpose unit that will simultaneously activate 3 function at once against an attacker for your protection. For the understanding of this new invention, the drawing will show how this unit function an how it's comes together as a whole ready to wear system.

Figure 2:
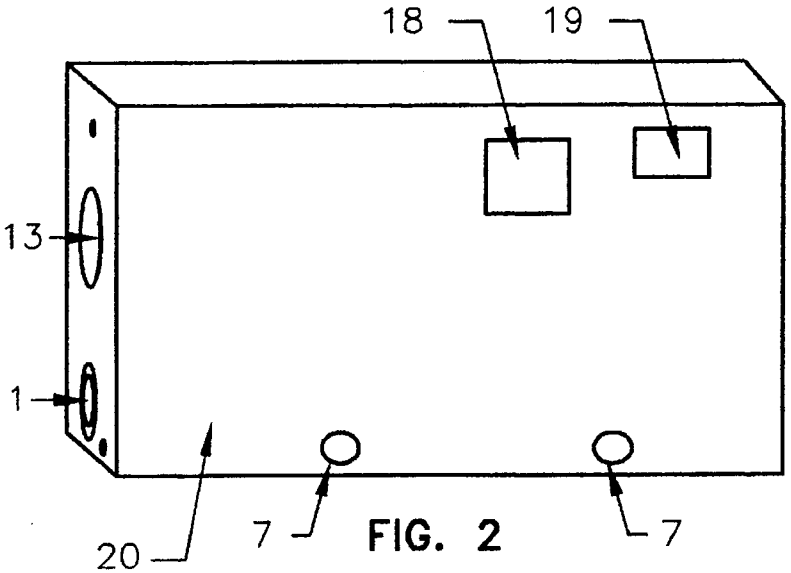
FIG. 2 shows the casing from the front view that shows it has the proper holed for the proper activations.
Figure 3:
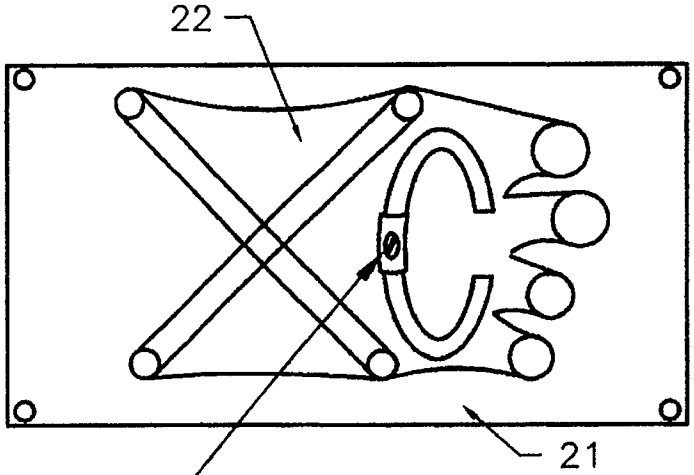
Figure 5A:
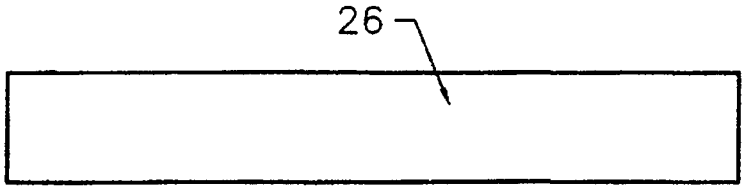
FIGS. 5*a* to 5*f* the views from the outside, which are the Top view, Bottom view, Right side view, Left side view, Front view an the Back view.
Figure 5B:
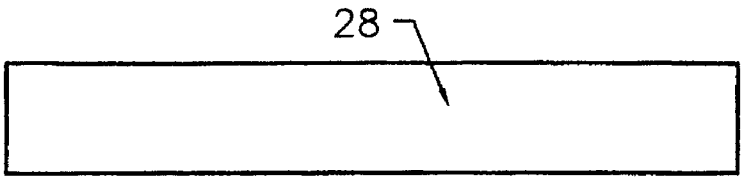
Figure 5C:
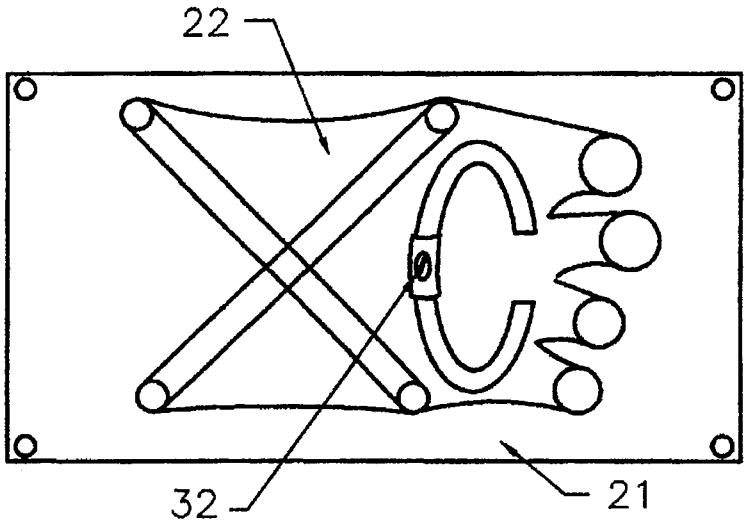
Figure 5D:
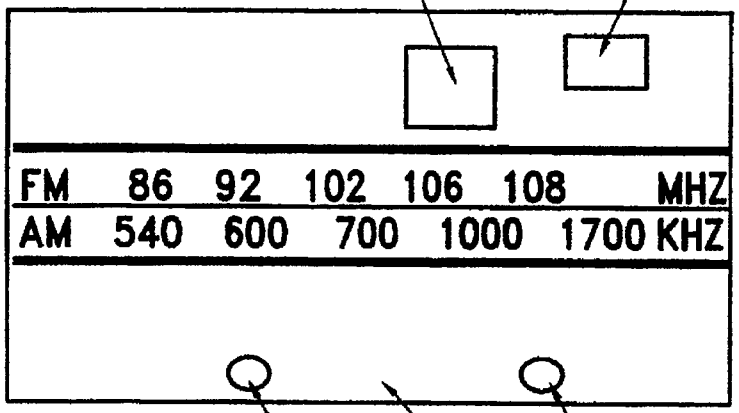
Figure 5E:
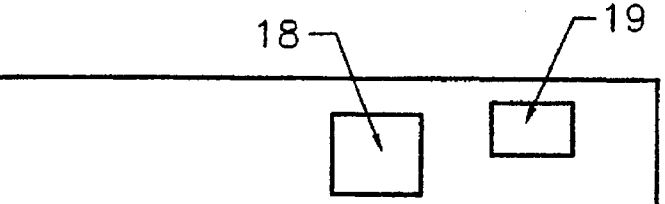
Figure 5F:
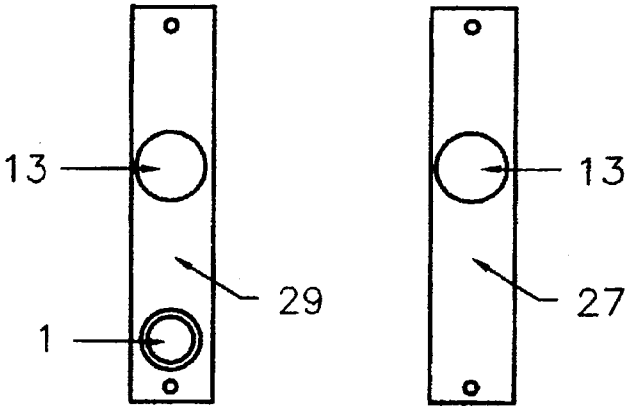

FIG. 1 The mini metal case 20 is in rear view showing it's encased embodiments, which is FIG. 2 from the front showing it has the proper holes for it proper activations an where it screws in to make it a whole unit, As seen in FIG. 1 when pushing in the on button 1 causing it to slide on the track guide 4 an locks, pushing the dye cylinder 3 that sits in the trigger hook 2, causing it to interject into the dye cylinder chamber 5, causing the dye to spray out of the spray valves 7 on the attacker, simultaneously causing the trigger hook 2 that has the base wire plate 6 that's apart of it, an showing the negative wire 10 an positive wire 11 running to the mini cassette player 12 with it's wires connecting to the speakers 13 that sits flush on the right side an the left side of the mini metal case 20, which plays the mini cassette tape 14 a call out for help. Than the negative wire 10 an positive wire 11 runs to the mini camera 15 activating the automatic shutter 16 to open an close the camera lens 18 seen in FIG. 2 view to expose the film 17 that takes pictures of the attacker, an the flash 19 seen in FIG. 2 which enables it to be used at night, When the dye cylinder 3 is interjected into the dye cylinder chamber 5, causing simultaneously for the base wire plate 6 to make contact to the battery tray 9 which hold two batteries 8, that relays the power that simultaneously activates the mini cassette player 12 an the mini camer 15.

When cleaning, retract the trigger hook 2 an the on button 1, remove the battery's 8 an the dye cylinder 3, an replace it with the gas cleaning cylinder 25 seen in FIG. 1*a* which than is placed into the trigger hook 2, interjecting it back into the dye cylinder chamber 5 blowing out the through the spray valves 7 to prevent clogging of the system.

FIG. 2 shows the mini metal case 20 from the front view, showing it has the proper holes for the proper activation for the lens 18 an flash 19 not seen in view of FIG. 1.

Figure 4:
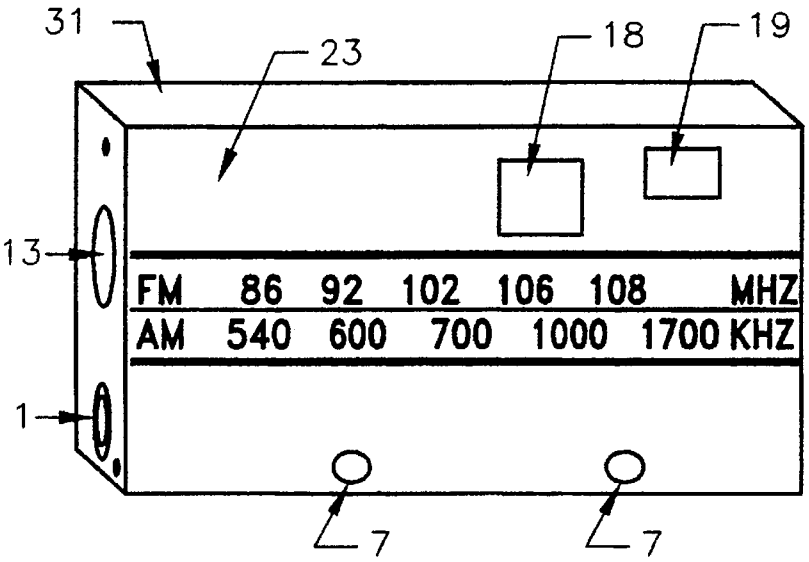
FIG. 4 slides over FIG. 2 which also has the same proper holes for the proper activations, this will cause it to look like a radio to the attacker.
Figure 3A:
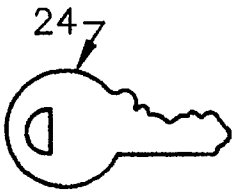
FIGS. 3 and 3*a* show the back base that secures to the back view of FIG. 1, that enables you to secure it to the back side of your hand an lock on your wrist, with the key that unlocks the cuff lock.

FIG, 3 shows back base 21 has the cross strap finger cuff 22 and lock 32, that's a part of the back base 21, that screws into the back of the corners of the mini metal case 20, securing it's embodiments, an FIG. 4 the exterior housing 31 that has the same proper holes, an from the front view 23 causing it to look like a radio that slides over the mini metal case 20 an screws into both sides, securing it, an when wearing it, sliding your hand under and through the cross strap finger cuff 22 an lock 32, that's worn on the back side of the hand, sliding your fingers through the open glove for a secure an relax fit, locking the lock 32, preventing it from being just taken off your arm, and only the key 24 can unlock the lock 32.

FIGS. 5*a* to 5*f* the views of the outer casing of the unit, with the top view 26 and bottom view 28 shows a flat surface of the unit, right side view 29 shows the speaker 13 an where the two screws go to secure it on that side, left side view 27 shows the speaker 13 and where the two screws go to secure it on that side, an the back base 21 screws into the back which secures it together as a complete ready to wear system.

Figure 6:
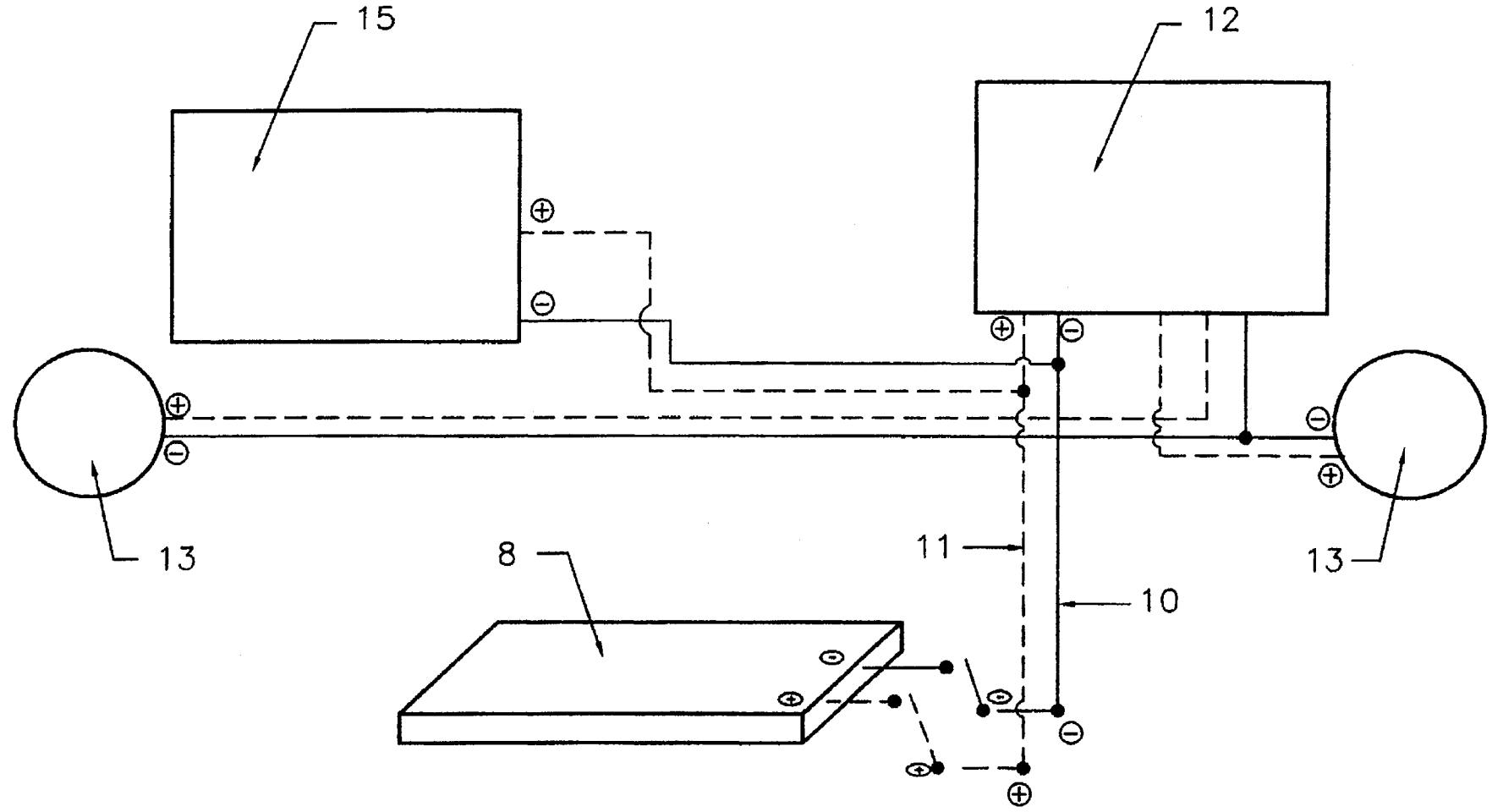
FIG. 6 shows the wire layout of the unit.

FIG. 6 shows the electrical layout which is shown in the embodiment of FIG. 1 that shows where they connect to cause the electrical function.

This completes the assembly, function and cleaning disclosure portions of the A-1-2-3, Body Guard Alarm.

I claim:

1. A self-contained A-1-2-3 Body Guard Alarm that simultaneously activates 3 functions by the push of a single button, causing: a color dye to spray out on an attacker, a built-in camera to cause pictures to be taken of the attacker, and delivery of a pre-recorded voice through activation of a built-in cassette player.

2. The A-1-2-3, Body Guard Alarm of claim 1 further composing an exterior housing in the appearance of a radio, in order to deter an attacker.

3. The A-1-2-3 Body Guard Alarm of claim 1 or 2, further comprising means which allows the alarm to be worn on a person and which prevents unauthorized removal from the person wearing it.

* * * * *